US005079030A

United States Patent [19]

Tomioka et al.

[11] Patent Number: 5,079,030

[45] Date of Patent: Jan. 7, 1992

[54] METHOD FOR PAINTING WATER BASE METALLIC PAINT

[75] Inventors: Yoshio Tomioka; Toshio Soma; Kengo Takano, all of Sayama, Japan

[73] Assignee: Honda Giken Kogyo Kabushiki Kaisha, Tokyo, Japan

[21] Appl. No.: 501,817

[22] Filed: Mar. 30, 1990

[30] Foreign Application Priority Data

Mar. 31, 1989 [JP] Japan ..... 1-83224

[51] Int. Cl.[5] ..... B05D 1/02

[52] U.S. Cl. ..... 427/27; 427/421; 118/629

[58] Field of Search ..... 427/421, 27; 118/626, 118/629

[56] References Cited

U.S. PATENT DOCUMENTS 4,132,357 1/1979 Blackington ..... 427/421

4,521,462 6/1985 Smythe ..... 427/421

4,785,995 11/1988 Yamane et al. ..... 118/626 X

*Primary Examiner*—Shrive Beck

*Assistant Examiner*—Alain L. Bashore

*Attorney, Agent, or Firm*—Armstrong, Nikaido, Marmelstein, Kubovcik & Murray

[57] ABSTRACT

A method for painting water base metallic paint on an object, such as the exterior of a vehicle, comprising the steps of painting such water base metallic paint on the object with a rotary atomizer to form on such object a coating of rotary atomizer painted water base metallic paint of a predetermined thickness and, thereafter, painting over such rotary atomizer painted coating, such water base metallic paint with an air spray gun to cover such rotary atomizer painted coating, and drying such coatings. One or more of such coatings may be painted electrostatically.

6 Claims, 2 Drawing Sheets

METHOD FOR PAINTING WATER BASE METALLIC PAINT

SUMMARY OF THE INVENTION

The present invention relates to a method for painting board portions, especially external board portions, of automobile bodies with water base metallic paint.

Conventionally, it is normal practice to paint water base metallic paint with an air spray gun (see Japanese Published Examined Patent Application No. 4846/1978).

However, because an air spray gun has a poor paint transfer efficiency, about 25 to 30%, the thickness of the coat attained in one spraying is around 4 microns. Thus, in order to obtain a coat of, e.g., 15 microns, it is necessary to repeat the spraying 4 times, one spraying after another.

Taken with the poor paint transfer efficiency, the plurality of air spray gun spraying with water base metallic paint is productivity poor.

Because rotary atomizer painting has a good paint transfer efficiency, about 60 to 80%, and a thickness of coat of about 8 to 11 microns can be obtained in one painting, painting of water base metallic paint with the rotary atomizer has advantages over air spray gun painting in order to reduce the number of painting. However, if water base metallic paint is painted with the rotary atomizer, the metal particles in the coat are irregularly arranged and a so-called darkening, having a dark or black appearance, is generated.

Applicants have discovered, as the result of high-speed camera photographing of painting conditions with water base metallic paint that, with the air spray gun, the striking velocity of the paint particles becomes as high as about 15 m/sec. and, upon striking the surface being painted, the metal particle shape and particle arrangement changes. On the other hand, with the rotary atomizer, the striking velocity of the paint particles is relatively low, about 2 m/sec. The paint particles, painted with the rotary atomizer are for the most part, not broken down and the metal particles remain irregularly arranged. It is this irregular arrangement of the metal particles which appear to give the rotary atomizer applied metallic paint, the darkening, dark or black appearance.

In the invention of the present application, the number of repeated painting is reduced and a water base metallic paint coating having a good appearance is attained. This is accomplished in the instant invention by first applying the water base metallic paint with a rotary atomizer and then applying the water base metallic paint with an air spray gun over the top of the rotary atomizer applied metallic paint.

BRIEF DESCRIPTION OF THE DRAWINGS

The invention will be more fully described and better understood from the following description taken with the appended drawings in which.

DETAILED DESCRIPTION

Figure 1:
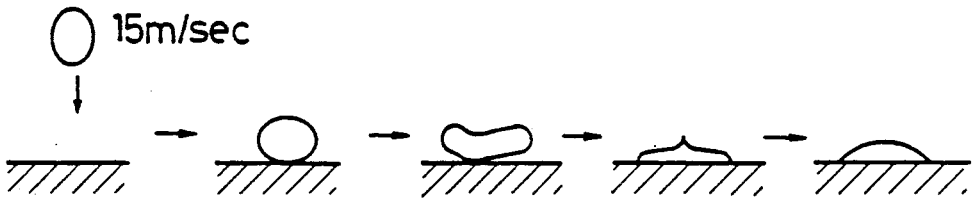
FIG. 1 is an explanatory diagram showing the condition of adhesion of a paint particle applied by means of an air spray gun.
Figure 3:
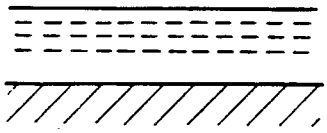
FIG. 3*a* is a schematic diagram showing a coat of metallic paint applied with an air spray gun.
FIG. 3*b* is a schematic diagram showing a coat of metallic paint applied with a rotary atomizer.
Figure 3:
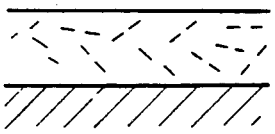

As best shown in the diagram in FIG. 1 of air spray gun painting of water base metallic paint, with the air spray gun striking velocity of the paint particles as high as 15 m/sec., the paint particles loose their shape upon striking the surface being painted. The metal particles, suspended in the paint in an irregular arrangement are caused, by the velocity, to move into an arrangement parallel to the surface being painted, as shown in FIG. 3*a*.

Figure 2:
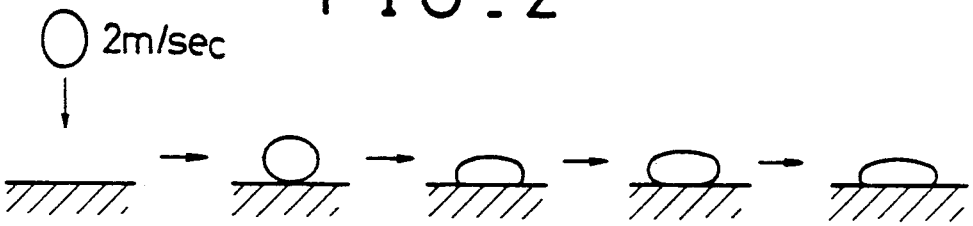
FIG. 2 is an explanatory diagram showing the condition of adhesion of a paint particle applied by means of a rotary atomizer.

As best shown in the diagram in FIG. 2 of rotary atomizer painting of water base metallic paint, with the rotary atomizer spraying velocity of the paint particles as low as about 2 m/sec., the paint particles adhere to the surface in the shape sprayed and without breaking up. Thus, as shown in FIG. 3*b*, such particles form a coating in which the metal particles are irregularly arranged. Hence, darkening in the coating is produced.

In the invention of this application, the water base metallic paint is first painted with a rotary atomizer, having a higher paint transfer efficiency than an air spray gun, to obtain a thick coating of the water base metallic paint on the surface being painted. If electrostatic painting is employed in this step, paint transfer efficiency is further improved and paint waste and painting time is reduced.

Next, the water base metallic paint is painted over the top of the rotary atomizer applied coating with an air spray gun. This is done before the atomizer applied coating has set or started to dry. Thus, the metal particles suspended in the coat previously applied by the rotary atomizer are pushed and moved by the air pressure of the spray gun into a substantially regular arrangement. With the metal particles in the spray gun applied coating in a substantially regular arrangement, as applied, and the metal particles in the rotary atomizer applied coating rearranged by the air pressure from the spray gun, a good metallic coat is obtained.

In the case of metallic paint of dark colors such as blue and the like, the darkening due to irregular arrangement of the metal particles is hardly striking to the eyes. Therefore, the water base metallic paint can be painted with the rotary atomizer up to 70 to 80% of the required thickness and the water base metallic paint may be painted by the air spray gun once on top of the coat previously obtained. In case of metallic painting of light colors such as silver and the like, the darkening easily strikes the eyes. Therefore, the water base metallic paint is painted with the rotary atomizer up to about a half of the required thickness and the water base metallic paint is repeatedly painted twice or more with the air spray gun on top of the coat previously obtained.

Further, if a time interval is provided between the painting step with the rotary atomizer and the painting step with the air spray gun, the coat made with the rotary atomizer becomes well settled on the surface of the object to be painted, thereby reducing waving of the surface. At the same time, because the moisture content on the surface of the coat evaporates, thus making the surface rather dry, the paint can be prevented from being pushed sideways by the air pressure of the air spray gun.

In this case, by heating the object to be painted during the time interval between the spray coatings, drying of the surface of the coat can be further accelerated.

Further, by painting the water base metallic paint to the external board portion of the automobile body with the rotary atomizer and by painting the internal board portion of the automobile body during the time interval, the overall painting time can be shortened.

Figure 6:
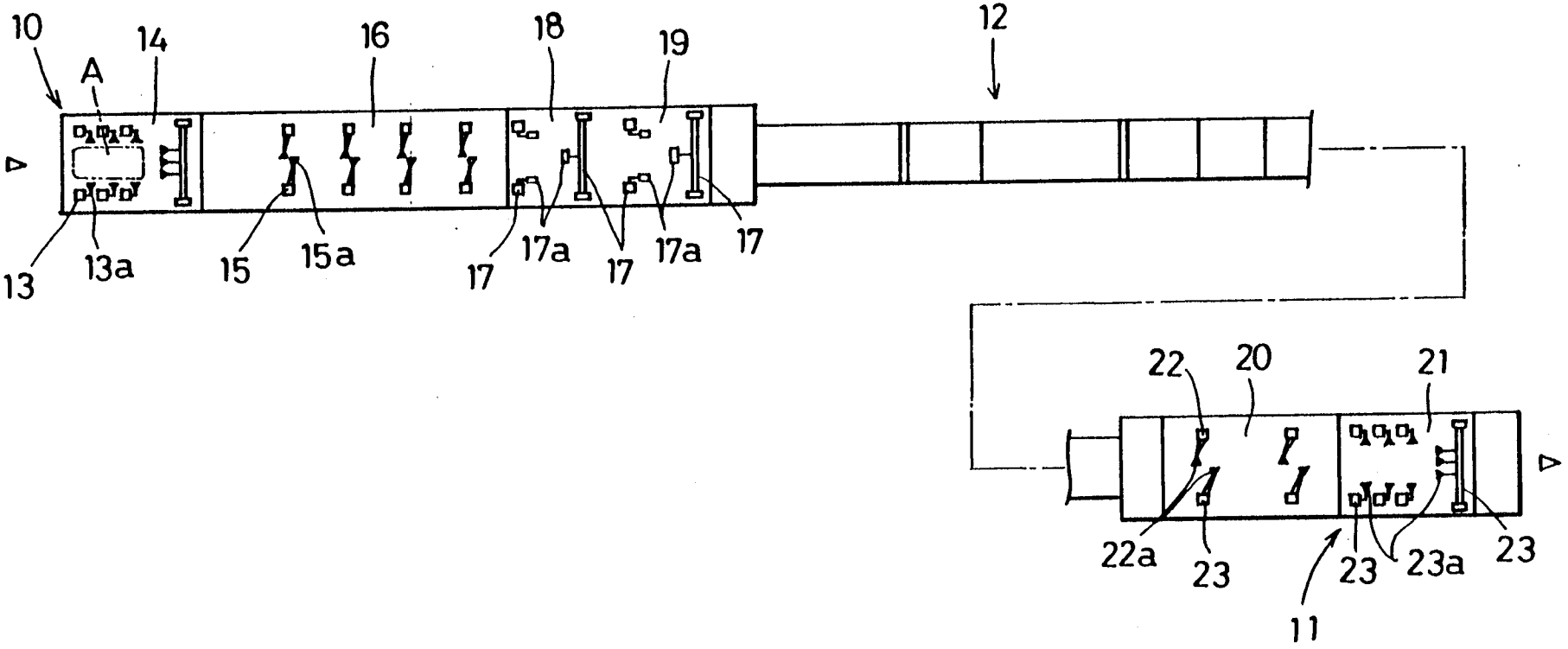
FIG. 6 is a diagram showing one example of a painting line for use in the practice of the method of the present invention.

FIG. 6 shows one example of a painting line for painting a water base metallic paint on an automobile body. In FIG. 6, reference numeral 10 denotes a front-stage paint booth wherein water base metallic paint is applied, 11 denotes a rear-stage paint booth for painting therein an oil base clear paint on top of the coat painted in the paint booth 10, and 12 denotes a predrying zone disposed between the paint booths 10, 11.

Inside the front-stage paint booth 10 there are disposed: a first paint station 14 provided with a plurality of reciprocators 13 equipped with bell-type paint guns 13*a* which are rotary atomizers, the first paint station 14 being positioned in communication with a paint station, not shown, for applying an intermediate coat; an interval zone 16 provided with a plurality of paint robots 15 equipped with bell-type paint guns 15*a*; and second and third paint stations 18, 19, respectively provided with a plurality of reciprocators 17 equipped with air spray guns 17*a*. Inside the rear-stage paint booth 11 there are provided: a fourth paint station 20 for painting a clear paint on the internal board portion of the automobile body A; and a fifth paint station 21 for painting a clear paint on the external board portion of the automobile body A. In the fourth paint station 20 there are disposed a plurality of paint robots 22 equipped with bell-type paint guns 22*a*, and in the fifth paint station 21 there are disposed a plurality of reciprocators 23 equipped with bell-type paint guns 23*a*.

Figure 4:
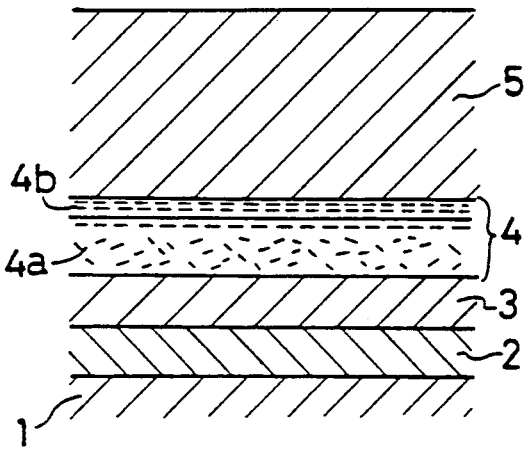
FIG. 4 is a schematic diagram showing an example of a coat of metallic paint obtained with the present invention.

FIG. 4 shows a construction of the coats on the external board portion 1 of the automobile body A, in which reference numeral 2 denotes a bottom coat and 3 denotes an intermediate coat. On top of the intermediate coat 3 a metallic coat 4 of dark color, such as dark blue, and the like, of about 15 microns thick and a clear coat 5 of about 35 microns thick are formed.

The metallic coat 4 is made up of a first coat 4*a* formed by painting a water base metallic paint with bell-type painting guns 13*a* in the first paint station 14 to a thickness of about 11 microns on top of the intermediate coat 3, and a second coat 4*b* formed by painting the water base metallic paint with air spray guns 17*a* in one of the second and the third paint stations 18, 19 to a thickness of about 4 microns on top of the first coat 4*a*. In this case after having painted the first coat 4*a*, the first coat 4*a* is left as it is in the interval zone 16 for 20 to 30 seconds in order to make it settled on the painting surface and, at the same time, to evaporate the moisture content on the surface. The evaporation of the moisture content may be accelerated by forcible heating in the interval zone 16. Then the second coat 4*b* is applied. Further, in the time interval at least one section of the internal board portion of the automobile body, such as around the door areas, door trims, the rear surface of a bonnet, the rear surface of a trunk lid, and the like, may be painted with the water base metallic paint by means of the bell-type paint guns 15*a*.

After having applied the second coat 4*b*, the automobile body A is forcibly heated to 50° to 80° C. in predrying zone 12 by means of radiation heating or heating with hot air to evaporate the moisture content in the first and the second coats 4*a*, 4*b*. Then, an oil base clear paint is painted on the internal board portion of the automobile body A with the bell-type paint guns 22*a* in the fourth paint station 20. In the fifth paint station 21 an oil base clear paint is painted to a thickness of about 35 microns over the second coat 4*b* to form the clear coat 5 and leave it as it is for 5 to 7 minutes to evaporate the solvent in the clear coat 5. Thereafter, clear coat 5 is dried and baked at a temperature of 140° to 150° C. in a baking and drying booth, not shown. In these steps, a good metallic coat, without darkening, has been obtained.

Figure 5:
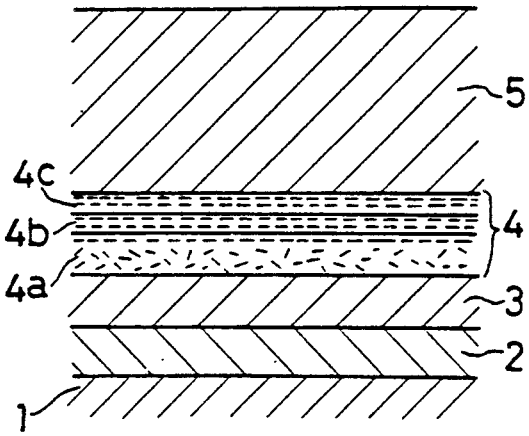
FIG. 5 is a schematic diagram showing another example of a coat of metallic paint obtained with the present invention.

Further, in the case of metallic coat of light colors, such as silver, and the like, the darkening is more conspicuous than in the metallic coat of dark colors. Therefore, as shown in FIG. 5, the first coat 4*a* is formed by painting the water base metallic paint 4*a* with the bell-type paint guns 13*a* in the first paint station 14 to a thickness of about 8 microns. After having left it as it is for 20 to 30 seconds in the interval zone 16, a second coat 4*b* and a third coat 4*c* are formed by repeatedly painting the water base metallic paint twice, one on top of the other, to a thickness of about 4 microns each in the second and the third paint stations 18, 19. In this case, the metallic coat 4 is formed by the first, the second and the third coats 4*a*, 4*b*, 4*c*.

Then, the automobile body A is forcibly heated in the predrying zone 12 to 50° to 80° C. to evaporate the moisture content in each coat 4*a*, 4*b*, 4*c*. Then, in the fourth paint station 22 the oil base clear paint is painted on the internal board portion of the automobile body A. In the fifth paint station 23 a clear coat 5 is formed by painting the oil base clear paint on top of the third coat 4*c* to a thickness of about 35 microns. Then, after leaving it as it is for 5 to 7 minutes to evaporate the solvent in the clear coat 5, clear coat 5 is dried and baked in the baking and drying booth, not shown, at a temperature of 140° to 150° C. As a result, a good metallic coat, without darkening, is obtained.

The interval zone 16 can also dually serve as the paint station for painting the internal board portion of the automobile body A. Consequently, as compared with the case in which the internal board portion of the automobile body is painted in a separate process, this is advantageous in that the time required for the overall painting process, as well as the length of the painting line, can both be shortened. Furthermore, it may be so arranged that the automobile body A is heated in the interval zone 16 by blowing hot air to the body or by means of heaters.

Further, the painting step of the water base metallic paint with the bell-type paint guns 13*a* may be performed by electrostatic painting or both the painting step with the bell-type paint guns 13*a* and the painting step with the air spray guns 17*a* may be performed by electrostatic painting.

The terms and expressions which have been employed in the foregoing description are used as terms of description and not of limitation, and there is no intention, in the use of such terms and expressions, of excluding any equivalents of the feature shown and described or portions thereof, but it is recognize that various modifications are possible within the scope of the invention claimed.

What is claimed:

1. A method for painting water base metallic paint on an object comprising the steps of:

(a) performing a first painting step on said object by applying a first coat of water base metallic paint by means of a rotary atomizer to an extent that a first coat of between substantially 50% and 80% of a required paint coat thickness is obtained, wherein metal particles in the paint of said first coat have an irregular arrangement, and (a) performing a second painting step on said object by applying a second coat of water base metallic paint over said first coat by means of an air pressure spray gun, wherein metal particles in the paint of said second coat have a substantially regular arrangement such that a darkening appearance of said metallic paint on said object is substantially reduced.

2. A method for painting water base metallic paint as recited in claim 1, wherein said second painting step is performed in a single painting operation to complete a paint coat of said required thickness.

3. A method for painting water base metallic paint as recited in claim 1, wherein said second painting step is performed in a plurality of painting operations to complete a paint coat of said required thickness.

4. A method for painting water base metallic paint as recited in claim 1, 2 or 3, wherein a time interval is provided between said first step and said second step.

5. A method for painting water base metallic paint as recited in claim 4, wherein the object being painted is heated during said time interval.

6. A method for painting water base metallic paint as recited in claim 2, 3 or 4, wherein at least said first painting step is performed by electrostatic painting.

* * * * *